United States Patent [19]

Ko

[11] Patent Number: 5,013,180

[45] Date of Patent: May 7, 1991

[54] RAISED PAVEMENT MARKING DEVICE

[76] Inventor: Myung D. Ko, Kangnam Apt., 18-Dong, 40-Ho, 1648-Shinrim-Dong, Kwanack-Ku, Seoul 151-0181, Rep. of Korea

[21] Appl. No.: 411,505

[22] PCT Filed: Mar. 6, 1989

[86] PCT No.: PCT/KR89/00005

§ 371 Date: Oct. 5, 1989

§ 102(e) Date: Oct. 5, 1989

[87] PCT Pub. No.: WO89/08743

PCT Pub. Date: Sep. 21, 1989

[30] Foreign Application Priority Data

Mar. 10, 1988 [KR] Rep. of Korea ..... 88/2499

[51] Int. Cl.[5] ..... E01F 9/00

[52] U.S. Cl. ..... 404/10; 404/9

[58] Field of Search ..... 404/6, 7, 9, 17, 71, 404/72, 77, 95; 126/271.1, 271.2 A

[56] References Cited

U.S. PATENT DOCUMENTS

| | | | |
|---|---|---|---|
| 1,489,270 | 4/1924 | Moldenhauer et al. | 404/9 |
| 3,612,035 | 10/1971 | Kronen | 126/271.1 |
| 4,349,010 | 9/1982 | Bentham | 126/271.1 |

FOREIGN PATENT DOCUMENTS

| | | | |
|---|---|---|---|
| 1124147 | 5/1982 | Canada . | |
| 3512066 | 10/1985 | Fed. Rep. of Germany | 404/77 |
| 812654 | 4/1959 | United Kingdom | 404/71 |
| 2177742 | 1/1987 | United Kingdom . | |

*Primary Examiner*—Ramon S. Britts
*Assistant Examiner*—Gay Ann Spahn
*Attorney, Agent, or Firm*—Watson, Cole, Grindle & Watson

[57] ABSTRACT

A raised pavement marking device for use in pavement roadways includes a conical body, a plurality of supporting legs, a cavity, a nozzle member, a plurality of apertures, and a reflector, whereby the device can effectively melt and dry snow ice and/or moisture on the pavement roadways.

1 Claim, 2 Drawing Sheets

FIG.1
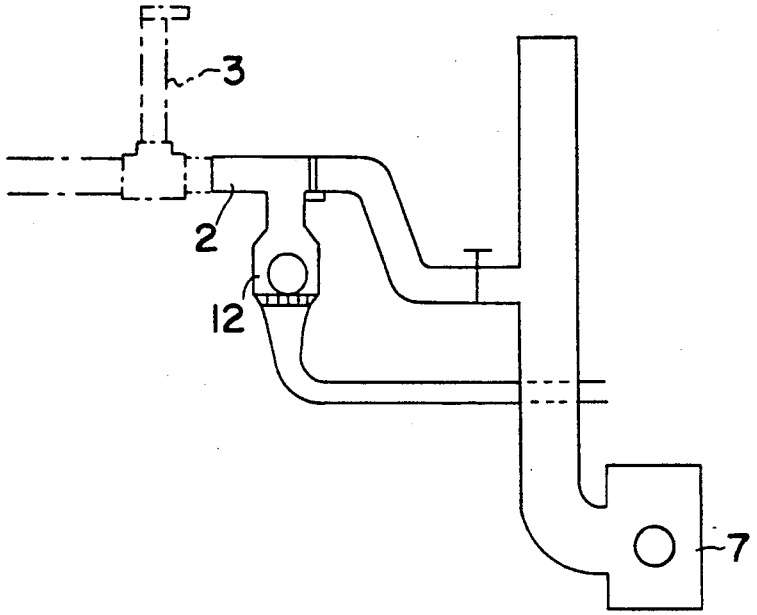
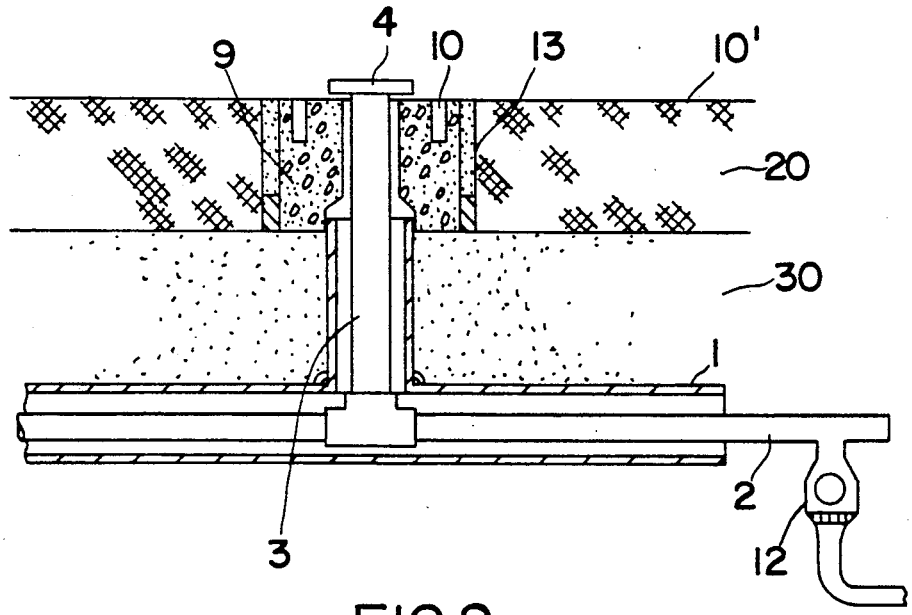
FIG.2

RAISED PAVEMENT MARKING DEVICE

BACKGROUND OF THE INVENTION (1) Field of the Invention

The present invention is related to providing a raised pavement marking apparatus for installing on a high level road a curve road, or an uphill road with a heavy snowfall.

(2) Description of the Prior Art

It has been well known in the art that the raised pavement marking device has the function for reflecting the light of the head light in order to represent the central line, getting over the driver's sleepy spell and showing the central line during it is raining or snowing. The conventional raised pavement marking device has been installed by way of striking it into the road or by using the adhesive agent, but even though a little amount of snow has been fell, the raised pavement marking device is invisible before the snow is melted or removed therefrom. Furthermore, since a snowplow cars or equipments must be mobilized to clear the pavement of snow, the traffic will be brought to a standstill for a moment. When a thawing chemical agent is used to melt the snow, it is a number of problems such as, for example, a supplementary budget is required as well as various road safety facilities, for example a guard rail, a street light and a traffic safety sign, installed on the road, and the car body are corroded and broken due to the agent.

SUMMARY OF THE INVENTION

Accordingly, an object of the present invention is to provide a raised pavement marking apparatus for melting and/or drying the snow or the rain.

The other object of the present invention is to provide a method for installing a raised pavement marking apparatus.

The present invention comprises the raised pavement marking apparatus including a duct pipe laid horizontally or vertically in the predetermined arrangement under the subbase course of the ground, a vertical connection pipe communicated by way of a nozzle with the cavity of the raised pavement marking device and a horizontal connection pipe inserted in the duct pipe and having numerous drain pipe and at least one air heater and compressor installed on the predetermined position, a raised pavement marking fixing hole formed in the surface course and the base course, a precast concrete block for fixing the vertical connection pipe and raised pavement marking device inserted in said fixing hole, at least one reflector mounted on its slant surface, a cavity formed in its central portion, a plurality of jet holes formed radially around it's periphery, which is communicated with the cavity, and a fixing pin for supporting the raised pavement marking device which is inserted into the fixing hole.

Therefore, the marking device of the present invention comprises the air pipe laid under the ground of the road, the air nozzle mounted on the front end of the connection pipe connected to the air pipe and communicated with the cavity of the raised pavement marking fixed on the surface of the road, whereby the heated air supplied through the air pipe is jetted out of the road surface through the nozzle and the raised pavement marking device can easily melt the snow piled on the road surface and also to remove the moisture therefrom, so that the road surface is always kept in the drying state in order to help the smooth travel of the vehicles.

BRIEF DESCRIPTION OF DRAWINGS

The above and other objects of the present invention will be seen by the following description taken in connection with the accompany drawings, in which:

FIG. 1 is a front elevational view illustrating the construction of the air heater and compressor of the present invention, FIG. 2 is a front elevational view illustrating the construction of the connection pipe portion of the present invention.

DETAIL DESCRIPION OF THE PRESENT INVENTION

Figure 3:
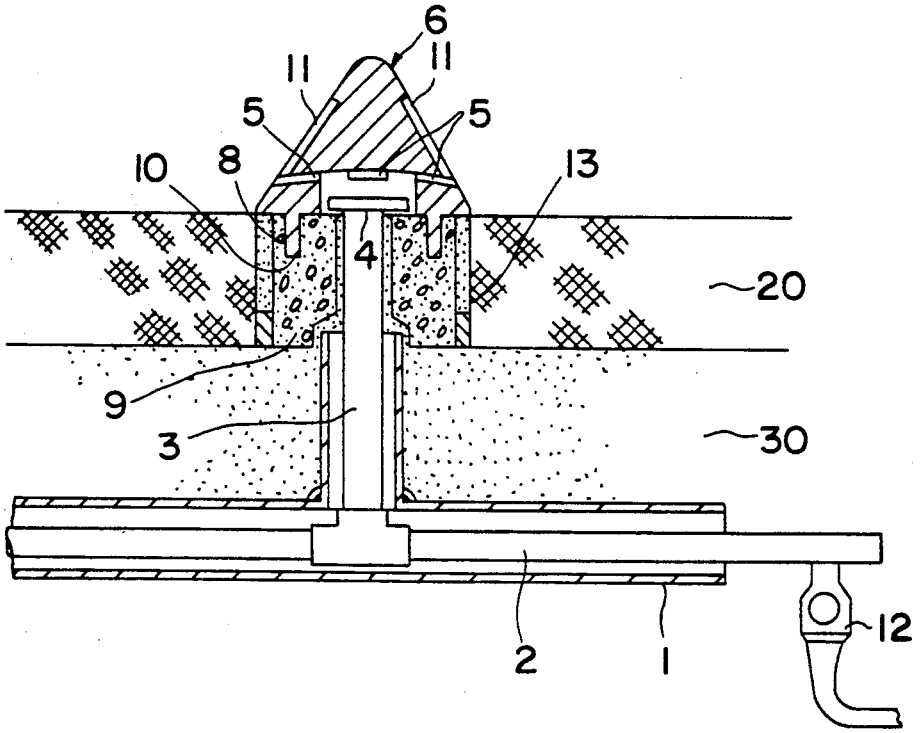
FIG. 3 is a front elevational view of the raised pavement marking device of the present invention containing cut-away portions in order to illustrate the construction of the device of the present invention.

Firstly, it is noted that the pavement road is generally constructed as three layers including a surface course 10', a base course 20 and a subbase course 30 as shown in FIGS. 5 and 6.

A duct pipe 1 has a T-shaped configuration and is disposed under the subbase course 30 of the ground in a predetermined arrangement. A horizontal connection pipe 2 is inserted into the duct pipe 1 and is provided with drain pipe 12 and an air heater/compressor 7 connected to the horizontal connection pipe 2 or an appropriate position thereof. A vertical connection pipe 3 is laid through the subbase course 30 to the surface and base course 20, one end of the vertical connection pipe 3 is connected to the predetermined position of the horizontal connection pipe 2 and the other end thereof is provided with a heated air nozzle 4 precast a concrete block 9 in inserted into a precast hole 13. The precast hole 13 is formed through the surface course 10' and base course 20 for retaining the vertical connection pipe 3. The raised pavement marking fixing hole 10 is disposed on the concrete block for fixing raised pavement marking device 6. The raised pavement marking device 6 has a cavity formed therein. The cavity is communicated with the nozzle 4 connected to the air heater/-compressor 7. A plurality of jet nozzles are 5 formed radially around the middle portion of the slant surface and a reflector 11 surrounds around and disposed on the upper portion of the slant surface for reflecting the light of the head light of the vehicles The method for installing the raised pavement marking apparatus of the present invention as described above will be explained below.

In order to installing raised pavement marking device 6 on the road, firstly, the horizontal boring is performed to form the boring hole through the side of the road. Thereafter, the vertical boring is performed at the position to be installed so that it is connected to the horizontal boring hole. The duct pipe 1 is inserted into the horizontal boring hole and the heated air pipe or horizontal connection pipe 2 is inserted into the duct pipe 1, and the vertical duct pipe 3 is inserted into the vertical boring hole so that the horizontal connection pipe 2 is connected to the vertical connection pipe 3 inserted into the vertical boring hole. Then, including the duct pipe 1 the vertical boring hole are filled with sands and the precast concrete block 9 is fitted onto the vertical connection pipe 3 connected to the horizontal connection pipe 2 both disposed in the T-shaped duct pipe 1 portion while its upper portion is filled with the filling material or the aspalt. Then, the nozzle 4 is mounted on vertical connection pipe 3 and positioned in the raised pavement marking 6. The raised pavement marking device 6 is fixed to the precast concrete block 9 with its fixing pin 8 being inserted into the fixing hole 10 of the precast concrete block 9.

The acting effect of the present invention will be described below.

In connection with the configuration of the present invention, when the raised pavement marking device 6 is mounted on the road and it shows, the air heater/-compressor 7 is operated to jet the heated air from the nozzle 4 through the horizontal connection pipe 2 and vertical connection pipe 3 so that the snow piled on the road is melted.

In connection with the installation of the present invention, since the horizontal boring is performed to form the boring hole on the side of the road referred to the sidewalk or the road shoulder in which the duct pipe 1 and the connection pipes 2 and 3 are inserted, it is not necessary to dig in the road surface so that the occurrence of the traffic obstacles is previously prevented. Also, when the boring is vertically performed on the road, the damage of the road surface may be prevented since only the small area of the road is bored.

Also, since the waterproof treatment is performed around the periphery of the precast concrete block 9, the precast concrete block 9 is kept in the plain state not to move or sink under the ground.

As described above, the present invention has a number of advantages such as, for example, it is convenience to install the raised pavement marking device in the road, and when it rains or snows, the air heater/compressor 7 is operated to melt the snow and also to dry the road surface so that the travel of the car is smoothly performed.

What is claimed is:

1. A raised pavement marking device disposed on pavement roadways, and connected to pipe connecting means, comprising:

a body member for safely driving a vehicle thereon;

a plurality of supporting legs extending from the bottom of said body member for inserting into apertures disposed on a concrete block;

a cavity disposed in the inside of said body member for keeping a hot air stream therewithin so as to immediately heat said pavement marking device;

a nozzle member disposed within said cavity for connecting to said pipe connecting means so as to supply the hot air stream;

a plurality of apertures communicated with said cavity, said plurality of apertures disposed radially around the outer surface of said body member; and a reflector surrounding and contacting the outer surface of the body member and disposed above said plurality of apertures, whereby when snow, ice, or water are on the pavement roadways, the raised pavement marking device can immediately, effectively melt or dry the snow or ice and moisture thereon, and gradually melt or dry the snow or ice and moisture therearound.

* * * * *